United States Patent [19]

Temple et al.

[11] 4,436,484

[45] Mar. 13, 1984

[54] TRANSVERSE FLOW FAN ROTOR

[75] Inventors: William F. Temple; Jesse Daniels, both of Albany, Ga.

[73] Assignee: Lilliston Corporation, Albany, Ga.

[21] Appl. No.: 369,607

[22] Filed: Apr. 19, 1982

[51] Int. Cl.[3] ..... F04D 29/28

[52] U.S. Cl. ..... 416/178; 416/187; 416/214 R

[58] Field of Search ..... 416/178, 187, 214 R

[56] References Cited

U.S. PATENT DOCUMENTS

| | | | |
|---|---|---|---|
| 2,115,367 | 4/1938 | Levy et al. | 416/178 |
| 2,421,254 | 5/1947 | Froelich | 416/187 |
| 2,987,172 | 6/1961 | Linsenmeyer | 416/187 |
| 3,181,778 | 5/1965 | Mayne | 416/214 R |
| 3,257,070 | 6/1966 | Kuklinski | 416/186 |
| 3,262,637 | 7/1966 | Sprouse et al. | 416/187 X |
| 3,694,881 | 10/1972 | Glucksman | 416/178 X |
| 3,832,091 | 8/1974 | Hoffman | 416/214 R |

FOREIGN PATENT DOCUMENTS

| | | | |
|---|---|---|---|
| 587408 | 11/1959 | Canada | 416/178 |
| 1082459 | 5/1960 | Fed. Rep. of Germany | 416/214 A |
| 1082766 | 6/1960 | Fed. Rep. of Germany | 416/214 R |
| 1360984 | 7/1974 | United Kingdom | 416/187 |

*Primary Examiner*—Everette A. Powell, Jr.

*Attorney, Agent, or Firm*—Newton, Hopkins & Ormsby

[57] ABSTRACT

A transverse flow fan rotor for the cleaning and separating system of a combine harvester and for other uses features a lightweight yet sturdy rotor structure which eliminates the need for machined shaft keyways, keys, set screws and pins for attaching rotor discs to a drive shaft. The discs are frictionally clamped to the shaft by the action of split tapered lock bushings and coacting opposing collars on opposite sides of each disc drawn together by bolts.

7 Claims, 6 Drawing Figures

TRANSVERSE FLOW FAN ROTOR

BACKGROUND OF THE INVENTION

Transverse flow fan rotors for combine cleaning and separating systems and for other uses are known in the prior art. The simple objective of this invention is to improve on the construction, capacity and overall operational efficiency of such fan rotors. One of the key factors is achieving better operational efficiency resides in reducing the mass of the fan rotor which in turn reduces its rotational inertia. The rotor capacity depends to a great extent on rotor shaft size and it is desirable to reduce shaft size to the greatest possible extent without weakening the rotor or damaging its integrity.

In accordance with the present invention, this objective of minimized rotor shaft size without loss of strength is achieved by a unique arrangement for frictionally clamping the several rotor blade supporting discs to the rotor shaft without the use of shaft keys, set screws, pins or adhesives. Thus, weakening of the rotor shaft by drill holes, machined grooves or slots and the like is entirely eliminated. Firm attachment of rotor discs to the shaft is achieved in the invention through the action of split constrictive tapered bushings and coacting clamp collars activated by bolts which lie outside of the shaft periphery.

Other features and advantages of the invention will become apparent during the course of the following description.

DETAILED DESCRIPTION

Figure 1:
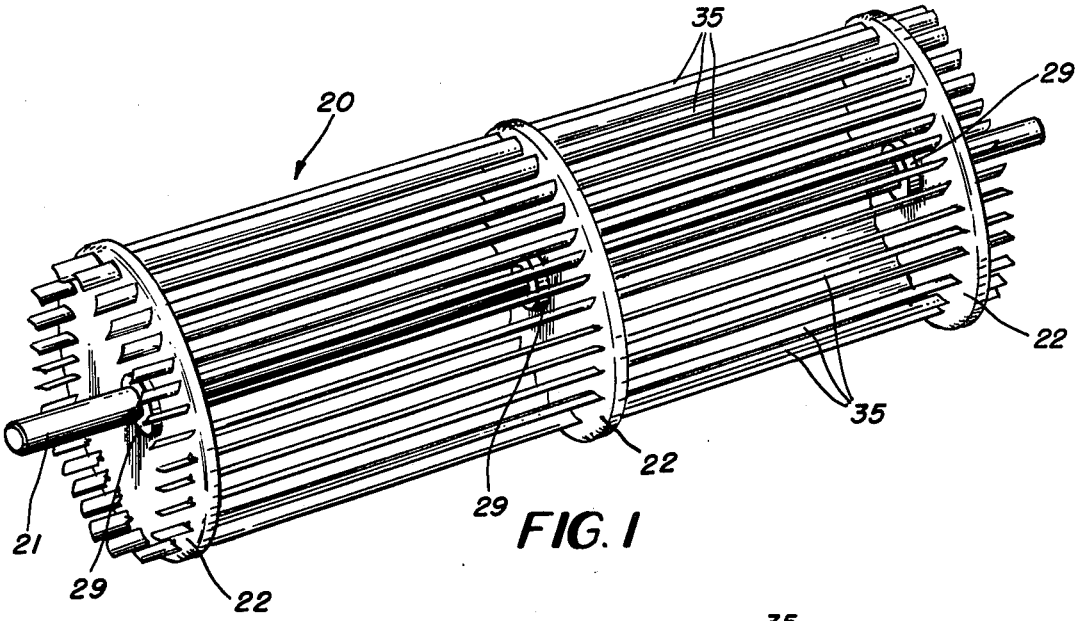
FIG. 1 is a perspective view of a transverse flow fan rotor according to the present invention.
Figure 2:
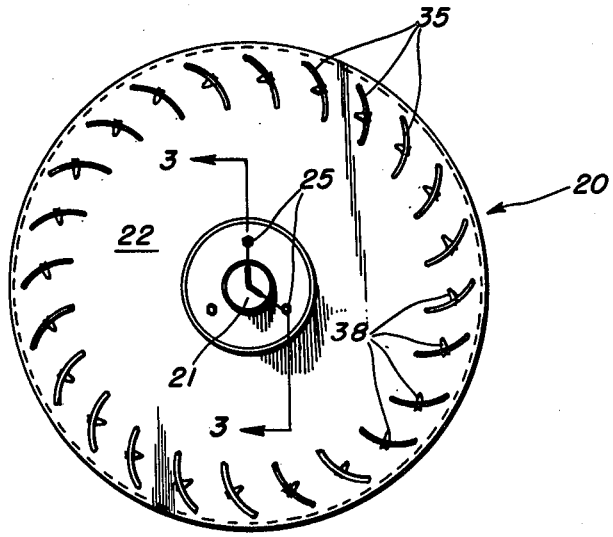
FIG. 2 is an end elevation of the fan rotor.

Referring to the drawings in detail wherein like numerals designated like parts, a transverse flow fan rotor 20 comprises a center axial shaft 21 of minimized diameter for proper strength and rigidity. The shaft is solid and is free of drilled openings, slots, keyway grooves or other machining which would tend to weaken it.

Secured to the shaft 21 in coaxial spaced relationship are blade supporting discs 22 which are firmly secured or locked on the shaft 21 frictionally by means constituting the main subject matter of the invention. The mounting of each disc 22 on the shaft being identical in the several discs, a detailed description of one mounting or securing means will suffice to describe them all.

Each disc 22 has a center opening 23 formed therethrough including circumferentially spaced radial locator notches 24 which receive axial clamping bolts 25, to be further described. Each disc mounting includes a conically tapered split steel clamping bushing or ring 26 whose divided ends 27 permit closing or constriction of the tapered bushing on the cylindrical shaft 21 to strongly grip it. The diameter of the bushing 26 in a relaxed unconstricted state is somewhat smaller than the diameter of the disc opening 23 whereby the bushing can actually pass through the opening 23.

Figure 3:
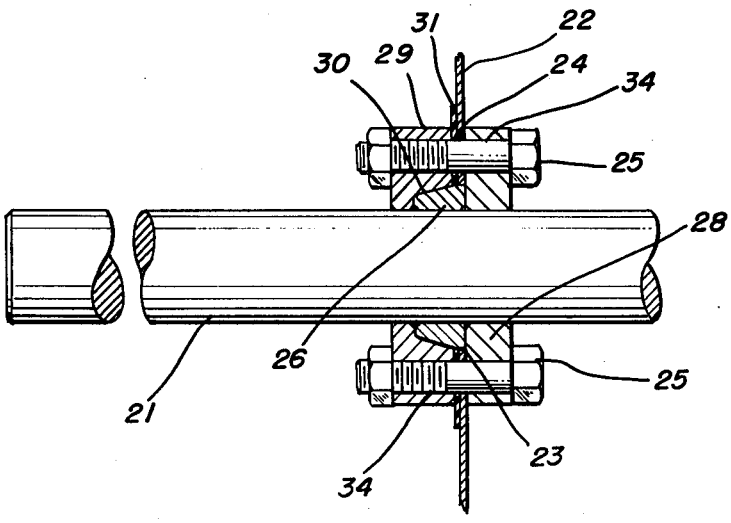
FIG. 3 is an enlarged fragmentary vertical section taken on line 3—3 of FIG. 2 showing details of the disc attaching structure.
Figures 4, 5, 6:
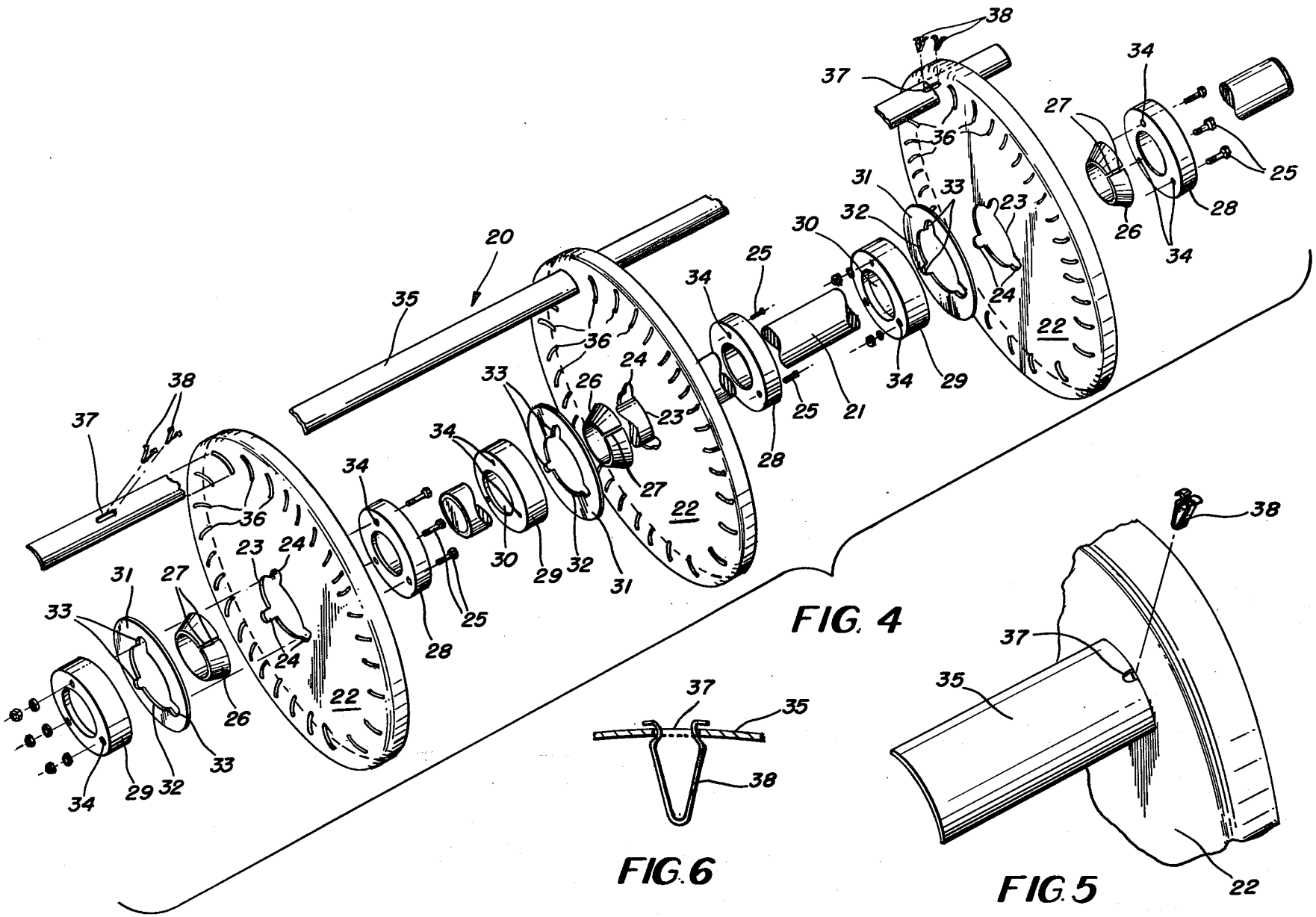
FIG. 4 is an exploded perspective view of the fan rotor, parts omitted.
FIG. 5 is a fragmentary enlarged partly exploded perspective view of rotor blade attaching means.
FIG. 6 is an enlarged fragmentary vertical section through one rotor blade depicting an attaching spring clip in place.

On one side of each disc 22, an annular clamping collar 28 is utilized in abutting relation with the larger end face of the tapered bushing 26 and with the corresponding end face of the disc 22. These two end faces will be flush, as shown in FIG. 3, in the completed disc mounting. On the opposite side of the disc 22, another annular collar 29 is provided having a conically tapered recess 30 opening through its interior end face and receiving the smaller end of the tapered clamping or locking bushing 26 to constrict it into gripping relation with the shaft 21. A rubber-like compressible gasket or shim 31 is placed between the disc 22 and the end face of the collar 29 having the tapered recess 30. The purpose of the elastic gasket is to compensate for variations in tolerance stack-up between the non-elastic elements 26 and 29 and to assure a tight clamping fit between the disc and the rigid collar 28. Each elastic gasket 31 has a shaft receiving opening 32 including circumferentially spaced radial notches 33 to receive the bolts 25.

With the described disc mounting components arranged relative to the disc 22 and shaft 21 as shown in FIG. 3, the three bolts 25 are placed through provided openings 34 in the two collars 28 and 29, such bolts lying radially beyond the periphery of the shaft 21 and being received in the disc locator notches 24. The bolts are tightened to draw the two collars 28 and 29 together axially and this drives the tapered split bushing 26 into the tapered recess 30 and closes or constricts the bushing on the shaft 21, thereby securely frictionally locking each disc 22 to the shaft 21 without any requirement for drilling, grooving, slotting or otherwise machining the shaft. This avoids weakening the shaft and enables the use of a shaft of minimum diameter.

The fan rotor further comprises a multiplicity of identical parallel elongated circumferentially equidistantly spaced thin curved blades 35 received through arcuate slots 36 of each disc 22, as shown. The blades 35 are of equal lengths and extend substantially for the entire length of the fan rotor. They are bodily supported on the discs 22 in spaced concentric relationship to the shaft 21.

Adjacent to the discs 22, the blades 35 have elongated slots 37 which receive releasable spring locking clips 38 in pairs placed closely on opposite sides of each disc. These clips position the blades axially loosely on the discs while the slots 36 position the blade circumferentially.

The rotor structure achieved by the invention is lightweight without loss of sturdiness and durability. Its construction with a comparatively small center shaft increases rotor capacity and efficiency, as stated.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A transverse flow fan rotor comprising a central axial rotor shaft, a plurality of axially spaced coaxial rotor discs of a uniform diameter on the rotor shaft and having central through openings receiving said shaft, said through openings having circumferentially spaced radial locator notches, conically tapered split constrictive bushings surrounding said shaft within the through openings, axially opposing substantially rigid pairs of clamping collars surrounding said shaft on opposite sides of said discs, one clamping collar of each pair having a conically tapered cavity receiving at least a part of the adjacent constrictive bushing, the opposing collar in each pair engaging the adjacent end face of the constrictive bushing to force it wedgingly into said cavity, a compressible shim element disposed between each disc and the adjacent end face of one of said clamping collars to compensate for tolerance vaiations, the clamping collars having bolt receiving openings formed therethrough in coaxial alignment with said locator notches, clamping bolts extending through the bolt receiving openings and locator notches, the discs each having a multiplicity of circumferentially equidistantly spaced fan blade mounting slots formed therethrough near and inwardly of their peripheries and spaced radially of the axis of said shaft in concentric relationship therewith, the blade mounting slots of the disc being in axial alignment, a corresponding number of elongated substantially equal length fan blades engaging through said slots of the disc and being supported therein relatively loosely, said fan blades having longitudinal slots formed therethrough at least adjacent to one of said discs and the slots being positioned within the blade mounting slots of the disc and extending on opposite sides of the disc, and pairs of releasable and readily removable spring locking elements engaged within said longitudinal slots of said blades on opposite sides of the disc and restraining the blades against axial displacement relative to said discs during the operation of the fan rotor and allowing ready removal and replacement of individual blades when required.

2. A transverse flow fan rotor as defined in claim 1, and said fan blade longitudinal slots being provided adjacent to the two endmost discs of the rotor and said pairs of spring locking elements being engaged within the slots of said blades on opposite sides of the two endmost discs.

3. A transverse flow fan rotor as defined in claim 1, and said spring locking elements comprising generally V-shaped spring elements having opposing divergent arms which are biased outwardly into releasable locking engagement with the opposite edges of the longitudinal blade slots and having their V-shaped body portions projecting radially inwardly of the blades toward the center of the rotor.

4. A transverse flow fan rotor as defined in claim 1, and the blade mounting slots of the discs and the blades engaging through such slots being arcuate.

5. A transverse flow fan rotor as defined in claim 1, and the plurality of rotor discs including a pair of endmost discs near opposite ends of the rotor and a center disc near the axial center of the rotor.

6. A transverse flow fan rotor as defined in claim 5, and each disc having an annular peripheral flange to provide stiffness in the disc.

7. A transverse flow fan rotor comprising a central axial rotor shaft, a plurality of axially spaced coaxial rotor discs of a uniform diameter on the rotor shaft and having central through openings receiving said shaft, said through openings having circumferentially spaced radial locator notches, conically tapered split constrictive bushings surrounding said shaft within the through openings, axially opposing substantially rigid pairs of clamping collars surrounding said shaft on opposite sides of said discs, one clamping collar of each pair having a conically tapered cavity receiving at least a part of the adjacent constrictive bushing, the opposing collar in each pair engaging the adjacent end face of the constrictive bushing to force it wedgingly into said cavity, a compressible shim element disposed between each disc and the adjacent end face of one of said clamping collars to compensate for tolerance variations, the clamping collars having bolt receiving openings formed therethrough in coaxial alignment with said locator notches, clamping bolts extending through the bolt receiving openings and locator notches, the discs each having a multiplicity of circumferentially equidistantly spaced fan blade mounting slots formed therethrough near and inwardly of their peripheries and spaced radially of the axis of said shaft in concentric relationship therewith, the blade mounting slots of the disc being in axial alignment, a corresponding number of elongated fan blades engaging through said slots of the disc and being supported therein, and releasable locking means for the blades engaged with the blades on opposite sides of at least one of said discs.

* * * * *